US009935406B2

(12) United States Patent
Nass et al.

(10) Patent No.: US 9,935,406 B2
(45) Date of Patent: Apr. 3, 2018

(54) PLUG

(71) Applicant: HARTING ELECTRIC GMBH & CO. KG, Espelkamp (DE)

(72) Inventors: Andreas Nass, Warmsen (DE); Hanno Harry Wolff, Nuremberg (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/505,848

(22) PCT Filed: Oct. 5, 2015

(86) PCT No.: PCT/DE2015/100412

§ 371 (c)(1),
(2) Date: Feb. 22, 2017

(87) PCT Pub. No.: WO2016/055055

PCT Pub. Date: Apr. 14, 2016

(65) Prior Publication Data

US 2017/0279228 A1 Sep. 28, 2017

(30) Foreign Application Priority Data

Oct. 9, 2014 (DE) ..... 10 2014 114 632

(51) Int. Cl.
*H01R 13/66* (2006.01)
*H01F 38/32* (2006.01)

(52) U.S. Cl.
CPC ..... *H01R 13/6666* (2013.01); *H01F 38/32* (2013.01)

(58) Field of Classification Search
CPC ..... H01R 13/6658; H01R 13/6666
See application file for complete search history.

(56) References Cited

U.S. PATENT DOCUMENTS

| | | | | |
|---|---|---|---|---|
| 2,427,390 A | | 9/1947 | Adams | 200/115.5 |
| 4,514,715 A | | 4/1985 | Chen | 337/113 |
| 4,872,081 A | * | 10/1989 | Murphy | H01R 13/6666 361/117 |
| 7,247,039 B2 | | 7/2007 | Annecke et al. | 439/188 |

(Continued)

FOREIGN PATENT DOCUMENTS

| | | | |
|---|---|---|---|
| DE | 1613706 | 5/1971 | H01F 27/40 |
| DE | 2656554 | 6/1978 | H01H 37/74 |

(Continued)

OTHER PUBLICATIONS

German Office Action issued in application No. 10 2014 114 632.8, dated Jul. 28, 2015 (6 pgs).

(Continued)

*Primary Examiner* — Xuong Chung Trans
(74) *Attorney, Agent, or Firm* — Hayes Soloway P.C.

(57) ABSTRACT

Provided is a plug for use as a disconnector for current transformers. Two types of short circuits are provided in the plug. A first short circuit is used for diverting overvoltages by short-circuiting the electrical contacts in the plug. A second short circuit is provided for short-circuiting electrical contacts in the plug when the plug is not contacted. The short circuits are designed in such a way that the first short circuit is used as a fuse when the second short circuit fails.

8 Claims, 4 Drawing Sheets

(56) References Cited

U.S. PATENT DOCUMENTS

| | | | | |
|---|---|---|---|---|
| 7,354,287 | B1 | 4/2008 | Hickam | 438/188 |
| 7,955,102 | B2 * | 6/2011 | Santos | H01F 27/04 439/188 |
| 2006/0172574 | A1 * | 8/2006 | Annecke | H01R 13/6666 439/188 |
| 2009/0186504 | A1 | 7/2009 | Santos | 439/188 |

FOREIGN PATENT DOCUMENTS

| | | | |
|---|---|---|---|
| DE | 3144580 | 5/1983 | H01R 13/514 |
| DE | 8609404 | 4/1988 | H01R 24/88 |
| DE | 10208402 | 9/2003 | H01R 13/646 |
| DE | 102005004920 | 8/2006 | H01R 13/703 |
| EP | 0908973 | 4/1999 | H01R 13/66 |
| EP | 1689047 | 8/2006 | F42B 3/182 |
| FR | 2758410 | 7/1998 | H01H 37/76 |
| GB | 1197299 | 7/1970 | H01R 13/70 |
| JP | H0271980 | 5/1990 | H01R 13/66 |
| JP | 2013084392 | 5/2013 | H01C 7/12 |
| WO | WO9909617 | 2/1999 | H01R 13/713 |

OTHER PUBLICATIONS

International Search Report (w/translation) and Written Opinion (no translation) issued in application No. PCT/DE2015/100412, dated Mar. 3, 2016 (14 pgs).

International Preliminary Report on Patentability issued in application No. PCT/DE2015/100412, dated Apr. 20, 2017 (9 pgs).

* cited by examiner

PLUG

BACKGROUND OF THE INVENTION

The invention relates to a plug connector comprising an insulating body having a plug-in side and a connection side.

Plug connectors of this type are required in order to provide a reversible electrical contact between electrical cables and an electric component or a further electrical cable. Plug connectors of this type can be provided in different sizes and embodiments depending upon the individual application case and component that is to be contacted.

BRIEF DISCUSSION OF THE PRIOR ART

DE 31 44 580 A1 discloses a modular plug connector having at least two contact elements that can be connected to one another in an electric manner by means of a contact bridge. The contact bridge closes an electrical contact between the contact elements when the plug connector is in the unplugged state.

JP H02-71 980 U and also JH 2013-84 392 A and EP 0 908 973 A2 disclose electric plug connectors whose contact elements are connected to one another by means of an overvoltage arrester.

DE 10 2005 004 920 P3 discloses a contact protecting means for plug connectors having a plugged state and a pre-assembled state in which in order to protect ignition contacts of the igniter pills against interference factors a protective device is provided in the contact protecting means, said protective device being in contact with a short circuit bridge in such a manner that during/after the short circuit bridge is disconnected the protective device automatically becomes effective.

US 2009/0186504 A1 discloses a multi-pole plug and plug socket having an automatic short circuit capacity between the poles for initiating an interruption between the plug and the plug socket.

DE 86 09 404 U1 discloses an electric plug connecting system comprising a pin-plug connector and a bush plug connector, wherein contact elements are inserted in a latching manner in the plug connectors arranged with intermediate gaps and in rows in recesses that are provided with latching devices.

A disadvantage in the case of electric plug connectors that are known from the prior art is that said plug connectors should only be disconnected, in other words separated, if the electric components that are connected to the plug connectors are no longer in operation. In other words, the electric components must be completely free of current and voltage before the connected plug connector can be disconnected. If this is not the case, it is possible in specific application cases for the plug connector to fail as a result by way of example of overvoltages in the plug connector.

In one specific application case, the secondary windings must always be short-circuited from current convertors (current transformers) when disconnecting connected devices. If the secondary windings are not short-circuited, considerable overvoltages can occur at the open ends of the secondary circuit.

The magnitude of the occurring voltage is dependent upon the current, core cross section and the number of secondary windings. Thus, in the case of current convertors up to approx. 500/5 A and low rated powers the peak value of the occurring voltage is mostly below 200 V. However, in the case of larger current convertors higher voltage peaks can occur that, in the event of the open clamps coming into contact with humans, represent a risk of the converter breaking down and flashovers can occur between the clamps.

If an electrical plug connector is connected to a current converter, these flashovers can occur at the plug connector and this leads to humans being at risk as a result of the flashovers or even as a result of a complete failure of the electric plug connector as a result of an explosion. The secondary circuits of current converters must therefore never be operated when open since particularly in the case of large currents and high performance cores life-threatening voltages can occur at a connected plug connector.

SUMMARY OF THE INVENTION

The object of the invention is therefore to provide an electric plug connector that diverts any occurring overvoltage through a short circuit and as a consequence minimizes the danger for the user. In addition, the electric plug connector is to guarantee protection for the user even in the event of a malfunction in the short circuit wiring and to prevent further use of a defective plug connector.

The invention relates to an electric plug connector comprising an insulating body having electrical contacts that are received in said insulating body. The insulating body forms a plug-in side and also a connection side. At least one pair of electric contacts is provided in the insulating body, said electric contacts comprising a first electric contact and a second electric contact.

The electric contacts comprise in each case a plug-in region and a connection region. The plug-in regions of the electric contacts are embodied as bushes or pin contacts depending upon the type of the individual plug connector and are arranged in the plug-in side of the insulating body.

The connection regions of the electric contacts comprise conductor connecting means. The conductor connecting means can be embodied to suit different types known from the prior art. Cage clamps, screw connectors, crimp or solder connectors are included in this case in the non-conclusive list of possibilities. The connection regions of the electric contacts are arranged on the connection side of the insulating body in order to render it possible in this case to connect to the electrical cables.

In accordance with the invention, the plug connector comprises also a first short circuit means in the insulating body. The first short circuit means renders it possible to produce in the insulating body an electrical connection between the first electric contact and the second electric contact.

The short circuit means is embodied as an overvoltage arrester. In other words, in the case of a defined excessively high voltage between the electric contacts a short circuit is produced between the electric contacts by means of the overvoltage arrestor.

In a preferred embodiment of the plug connector, a permanent electric short circuit that can no longer be disconnected is produced between the electric contacts in the event of an overvoltage. The permanent short circuit forces the user to replace the plug connector and analyze the cause of the malfunction.

A special embodiment of the present invention proposes to provide a blocking device on the plug connector. The mechanical blocking device comprises a blocking means that is suitable for protruding into the plug-in side of the insulating body and thus for preventing that the plug connector is plugged into a mating plug connector.

The blocking device in the plug connector is embodied so that the first short circuit means influences the blocking device in the event of an overvoltage. In the event of the short circuit means being triggered by an excessively high voltage, the blocking device is triggered in addition to the electric short circuit between the electric contacts. The blocking means is thus moved into the plug-in side of the insulating body so that it is no longer possible to plug the plug connector into a mating plug connector. The defective, permanently short circuited plug connect can thus no longer be contacted.

In addition to the first short circuit means, a second short circuit means is embodied on the plug connector in a preferred embodiment so as to connect the first electric contact and the second electric contact in an electric manner. When the second short circuit means is spring-loaded, it represents an electrical connection between the first electric contact and the second electric contact. An actuator is provided on the plug-in side of the insulating body and renders it possible to disconnect the electrical connection of the second short circuit means against the resilient force.

The actuator is preferably embodied in such a manner that it can be actuated by means of a mating plug connector upon being plugged into the plug connector. By virtue of plugging in the plug connector, the second short circuit means is thus opened and the electrical connection between the contacts disconnected.

In a particularly preferred embodiment, the actuator is provided on the plug-in side of the insulating body in lieu of a further contact. The actuator can thus be actuated by means of a contact of a mating plug connector and thus the electrical connection can be opened by means of the short circuit means during the mating procedure.

The present invention describes plug connectors having two types of short circuit means: a first short circuit means that in the case of an overvoltage between the electric contacts produces a short circuit between said electric contacts so as to divert the overvoltage; also a second short circuit means that produces a short circuit between the electric contacts as soon as the plug connector is unplugged.

By means of the actuator on the plug-in side, the short circuit of the second short circuit means is disconnected during the mating procedure with a mating plug connector. Should the actuator and the second short circuit means fail once, an overvoltage can be diverted by means of the first short circuit means and an accident prevented. In addition, in this case the blocking device prevents the plug connector from being plugged back in.

In a special embodiment, the plug connector is constructed in a modular manner. The plug connector comprises a retaining frame for plug connector modules. Depending upon the application, different types of plug connector modules are inserted in the retaining frame and form the plug connector. Another embodiment provides that additional modules are placed on a plug connector, wherein the additional modules comprise a first and/or second short circuit means. As a consequence, it is possible to retrofit an existing plug connector in order to impart it with the advantages of the present invention.

BRIEF DESCRIPTION OF THE DRAWINGS

Exemplary embodiments of the invention are illustrated in the drawings and further explained hereinunder. In the drawings.

The figures include in part simplified, schematic illustrations. Identical reference numerals are used in part for identical but where appropriate non-identical elements. Different views of identical elements could be scaled differently.

DETAILED DESCRIPTION OF THE INVENTION

Figure 1:
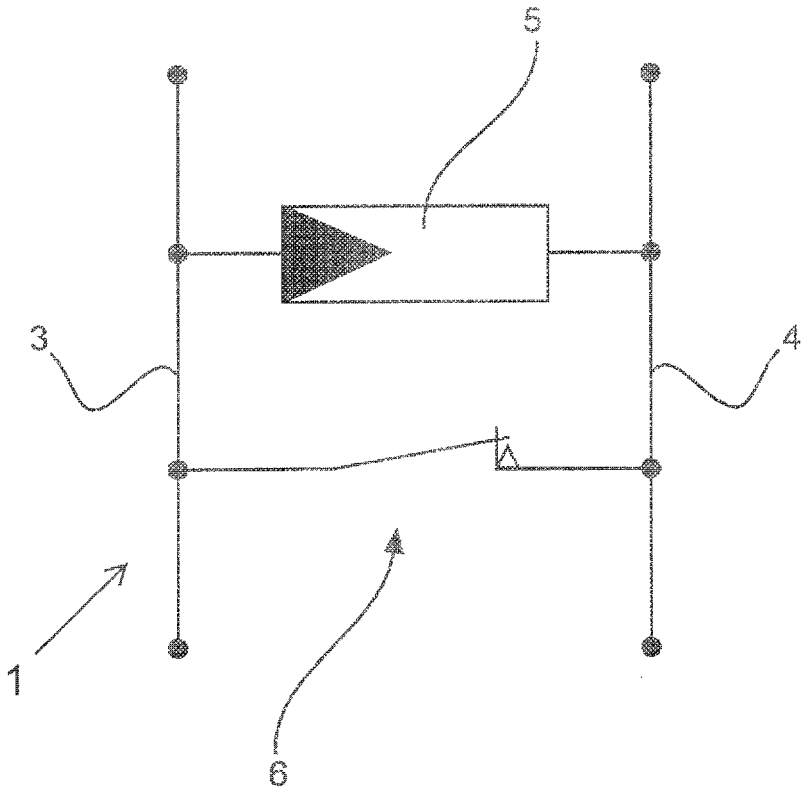
FIG. 1 illustrates an electrical circuit diagram of the plug connector in accordance with the invention.

FIG. 1 illustrates an electrical circuit diagram of a plug connector 1 in accordance with the invention. The circuit diagram illustrates a first electric contact 3 and also a second electric contact 4 on the left-hand or right-hand outer side. The two electric contacts 3, 4 are connected to one another in an electric manner at two sites.

A first connection between the electric contacts 3, 4 is formed by means of a first short circuit means 5. The first short circuit means 5 is embodied as an overvoltage arrestor. In the case of an excessively high voltage between the first electric contact 3 and the second electric contact 4, the overvoltage arrestor produces a permanent electrical connection between the electric contacts 3, 4.

A second connection between the electric contacts 3, 4 is formed by means of a second short circuit means 6. The second short circuit means 6 is embodied as an opening device. When the switch is spring loaded, it represents an electrically conductive connection between the first electric contact 3 and the second electric contact 4. An actuator 6.1 that is provided so as to open the second short circuit means 6 is further described in FIG. 3.

Figure 2:
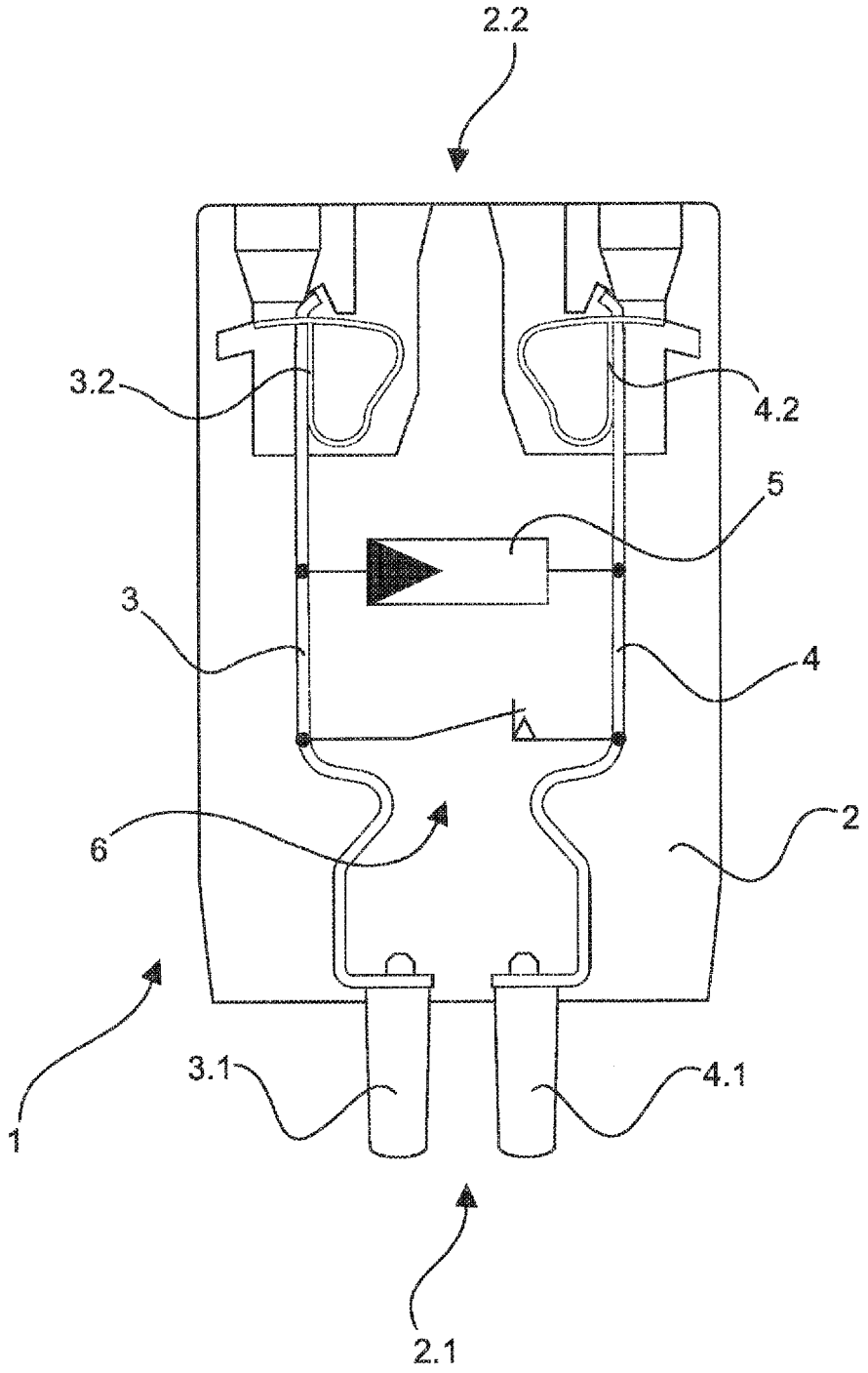
FIG. 2 illustrates a schematic view of a plug connector in accordance with the invention in a first exemplary embodiment.

A schematic illustration of a first exemplary embodiment of the plug connector 1 in accordance with the invention is illustrated in FIG. 2. The figure illustrates the plug connector 1 that is formed from an insulating body 2. The insulating body 2 has received in the interior a first electric contact 3 and also a second electric contact 4.

The electric contacts 3, 4 comprise in each case a plug-in region 3.1, 4.1 and a connection region 3.2, 4.2. The plug-in regions 3.1, 4.1 form a plug-in side 2.1 of the insulating body 2. The opposite-lying connection regions 3.2, 4.2 are provided so as to connect electrical conductors. For this purpose, the connection regions 3.2, 4.2 are equipped with cage clamps that are provided in a connection side 2.2 of the insulating body 2.

In accordance with the invention, the first short circuit means 5 and the second short circuit means 6 are arranged between the first electric contact 3 and the second electric contact 4. The first short circuit means 5 is embodied as an overvoltage arrestor. The second short circuit means 6 is provided as a spring-loaded opening device in the insulating body 2. Said spring-loaded opening device is illustrated in more detail in FIG. 3.

Figure 3:
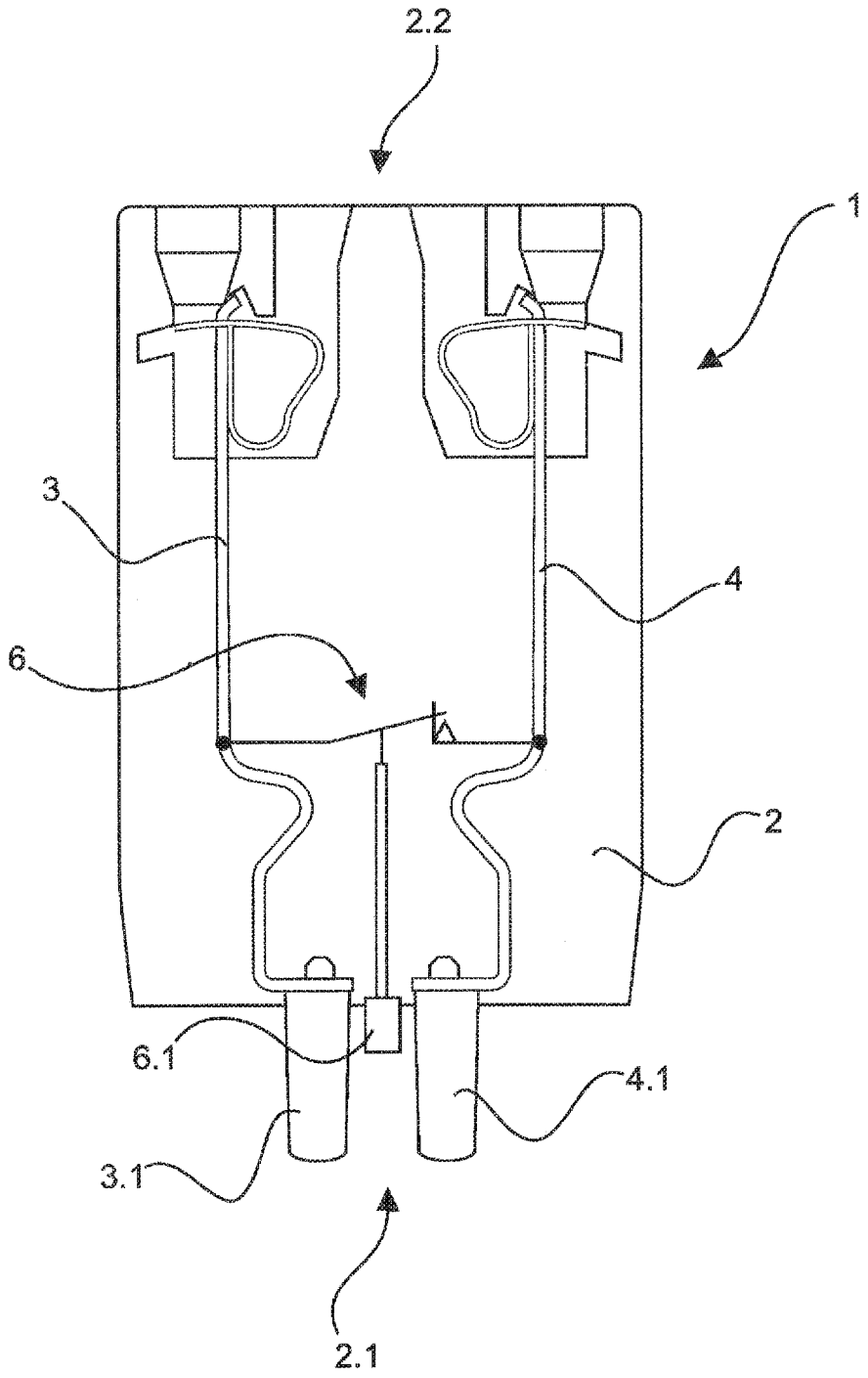
FIG. 3 illustrates a schematic view of a plug connector in accordance with the invention in a second exemplary embodiment.

FIG. 3 illustrates a schematic view of a plug connector 1 having a second short circuit means 6. The second short circuit, means 6 is equipped with an actuator 6.1. The actuator 6.1 is provided so as to open the short circuit means 6. For this purpose, the actuator 6.1 protrudes into the plug-in side 2.1 of the insulating body 2. As a result of the contact between the plug connector 1 and a mating plug connector, the actuator 6.1 is thus pushed into the insulating body 2 and the short circuit means 6 is opened. The electrical connection between the first electric contact 3 and the second electric contact 4 is disconnected in this manner.

Figure 4:
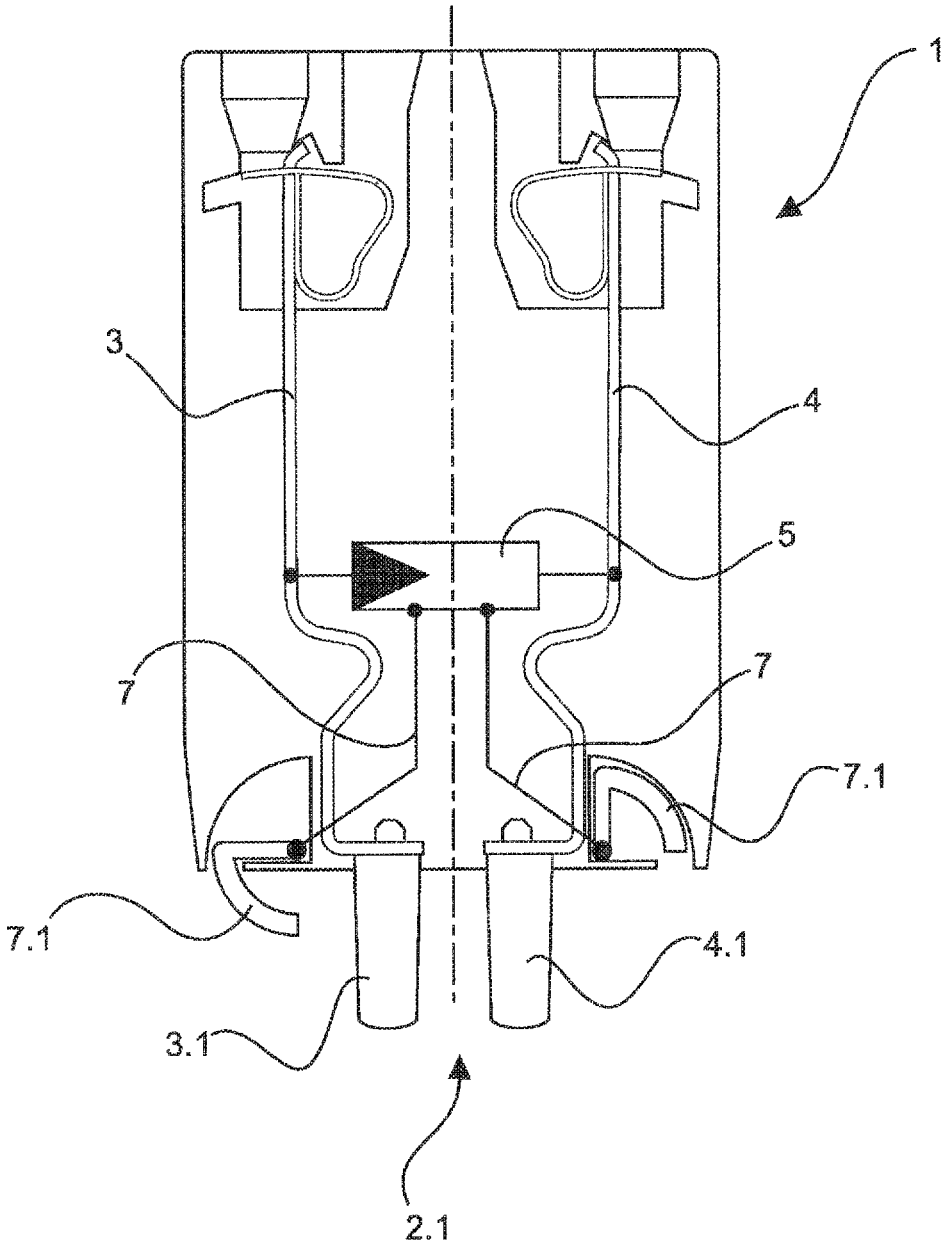
FIG. 4 illustrates a schematic view of a plug connector in accordance with the invention in a third exemplary embodiment.

FIG. 4 illustrates a schematic view of a plug connector 1 having a first short circuit means 5. The first short circuit means 5 connects the first electric contact 3 to the second electric contact 4. The first short circuit means 5 is embodied as an overvoltage arrestor. In the event of an overvoltage between the electric contacts 3, 4, the first short circuit means 5 represents an electrical permanent connection between the electric contacts 3, 4.

In this special exemplary embodiment, the plug connector 1 comprises in addition a blocking device 7. This blocking device 7 is coupled to the first short circuit means 5. If the first short circuit means 5 is triggered and an electrical connection between the electric contacts 3, 4 produced, the blocking device 7 is also triggered. This blocks the plug-in side 2.1 of the insulating body 2. The plug connector 1 is thus prevented from being plugged back in.

In the schematic view in FIG. 4, the blocking device 7 is illustrated in the initial state on the right-hand side near the electric contact 4. The blocking device 7 is illustrated in the triggered-state on the left-hand side near the electric contact 3.

A blocking means 7.1 is allocated to the blocking device 7 and in the initial position (right-hand side of FIG. 4) is mounted by way of example in a pre-stressed manner in the insulating body 2. The blocking means 7.1 is connected by means of the blocking device 7 to the first short circuit means 5. When the first short circuit means 5 is triggered as a result of an overvoltage (left-hand side of FIG. 4), the blocking device 7 is activated and the pre-stressed blocking means 7.1 moves into the plug-in side 2.1 of the insulating body 2. The blocking means 7.1 blocks the plug-in side 2.1 as a result of which it is no longer possible to plug the plug connector 1 back into the mating plug connector. It is preferred that the blocking means 7.1 latches permanently in this position so that it is no longer possible to reverse the defective state of the plug connector 1.

LIST OF REFERENCE NUMERALS

1 Plug connector
2 Insulating body
2.1 Plug-in side
2.2 Connection side
3 First electric contact
3.1 Plug-in region
3.2 Connection region
4 Second electric contact
4.1 Plug-in region
4.2 Connection region
5 First short circuit means
6 Second short circuit means
6.1 Actuator
7 Blocking device
7.1 Blocking means

The invention claimed is:

1. A plug connector comprising an insulating body having a plug-in side and a connection side, and at least one first electric contact and at least one second electric contact that are received in the insulating body, wherein the electric contacts form on a first end a plug-in region and on a second end form a connection region, wherein the plug-in region is embodied as bush contacts or pin contacts on the plug-in side of the insulating body, and the connection region provides a conductor connector in the connection side of the insulating body, wherein the insulating body comprises a first short circuit by which the first electric contact and the second electric contact can be connected in an electric manner, wherein the plug connector comprises a second short circuit that when spring-loaded produces an electrically conductive connection between the first electric contact and the second electric contact, wherein the second short circuit is allocated by an actuator on the plug-in side of the insulating body and the electrically conductive connection between the electric contacts can be disconnected by said actuator, and wherein the first short circuit is an overvoltage arrestor adapted to create an electric short circuit and produce a permanent electrical connection between the first electric contact and the second electric contact.

2. The plug connector as claimed in claim 1, wherein a blocking device is embodied on the plug connector and said blocking device comprises a block, wherein the block is suitable for the purpose of protruding into the plug-in side of the plug connector.

3. The plug connector as claimed in claim 2, wherein the first short circuit is adapted to influence the blocking device.

4. The plug connector as claimed in claim 1, wherein the actuator of the second short circuit protrudes into the plug-in side of the plug connector.

5. The plug connector as claimed in claim 1, wherein the actuator is adapted to be actuated by a mating plug connector that is to be plugged in and the electrically conductive connection between the electric contacts can be disconnected.

6. The plug connector as claimed in claim 1, wherein the plug connector is adapted to connect a current convertor.

7. The plug connector as claimed in claim 1, wherein the plug connector is adapted to be used as a disconnecting switch for a current convertor.

8. The plug connector as claimed in claim 1, wherein the plug connector is constructed in a modular manner.

* * * * *